United States Patent [19]

Murray et al.

[11] Patent Number: 4,640,735

[45] Date of Patent: Feb. 3, 1987

[54] CYLINDER ASSEMBLY COVERING REMOVER

[76] Inventors: Leroy J. Murray, 15B Howd Ave., Stony Creek, Conn. 06405; Lawrence N. Olson, 23 Norwood Rd., New Haven, Conn. 06513; Robert Chavoya, 210 Okenuck Trail, Stratford, Conn. 06497; James Wade, 100 Saw Mill Rd., Stony Creek, Conn. 06405

[21] Appl. No.: 698,379

[22] Filed: Feb. 5, 1985

[51] Int. Cl.[4] ..... B32B 31/18

[52] U.S. Cl. ..... 156/584; 30/169; 81/45; 156/344; 254/131

[58] Field of Search ..... 30/116, 169; 145/1 A; 156/344, 584; 254/131; 81/45

[56] References Cited

U.S. PATENT DOCUMENTS 3,836,119 9/1974 Saucier et al. ..... 254/131

4,009,743 3/1977 Ackerman ..... 30/169 X 4,481,059 11/1984 Steck ..... 156/344 X

*Primary Examiner*—Robert A. Dawson

[57] ABSTRACT

The invention is directed to a covering remover, the covering including roofing shingles. Removal of roofing shingles and other coverings presently requires hand tools, such as crow bars, hammers, shovels and nail pullers. This manual method is time and labor-intensive, as roofing needs to be removed in small individual sections. The present invention comprises a cylinder assembly with a rotatable shaft within the cylinder. Strapping is attached to and extends from the cylinder. A lifting force underneath the covering to be removed is accomplished when the cylinder assembly is rotated about its axis. This rotating assembly lifts whole sections of roofing and when removed from the cylinder, leaves the rolled-up section in a bale for convenient disposal.

5 Claims, 9 Drawing Figures

CYLINDER ASSEMBLY COVERING REMOVER

TECHNICAL FIELD

Construction: replacement and repair of roofing and coverings.

BACKGROUND ART

Current methods require removal of coverings, such as roof shingles, with hand tools.

The present invention removes coverings more efficiently by using a mechanically driven cylinder assembly which lifts coverings in whole sections.

SUMMARY

In the construction industry, particularly in the residential sector, replacement of roofing requires the removal of old roofing using hand tools such as crow bars.

This method is time and labor-intensive.

The present invention enables the removal of old coverings in less time, and with greater safety.

The invention removes coverings by the insertion of strapping underneath and lifting by rotational force around a mechanically driven cylinder.

BEST MODE FOR CARRYING OUT THE INVENTION

The present invention is a covering remover comprising a cylinder assembly with a rotatable shaft within the cylinder. Strapping is attached to and extends from the cylinder. A lifting force is exerted underneath the covering by rotational means.

In use, the cylinder assembly is positioned at one end of the section of covering to be removed. Strapping is inserted underneath in multiple strips and the ends are then attached to the cylinder. The far ends of the strapping are anchored into the substrate of the roof.

The cylinder is then rotated in the direction of the strapping and thereby lifts the covering off the substrate as it rotates across.

Upon removal of the covering, the cylinder is removed from the resulting bale of covering, the remaining strapping is removed from the substrate and the bale is disposed of.

Figure 1:
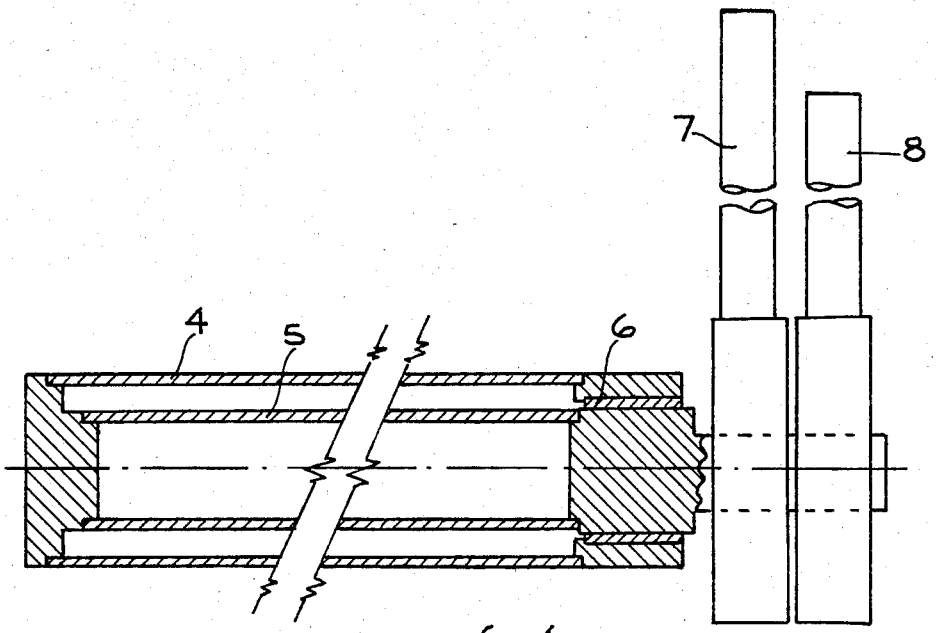
FIG. 1 is a view taken centrally through the device along the line 1—1 in FIG. 2.
Figure 2:
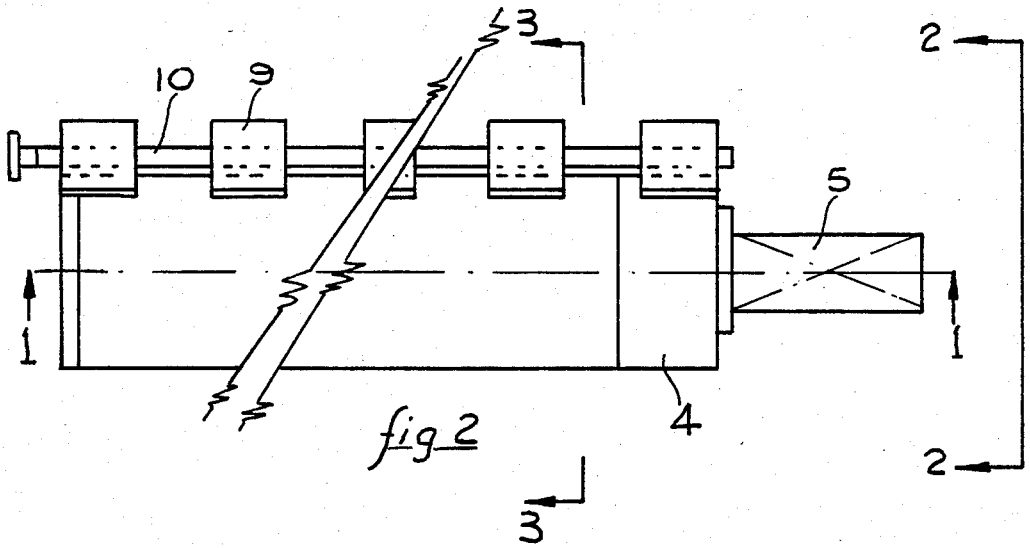
FIG. 2 is a top plan of the device.
Figure 3:
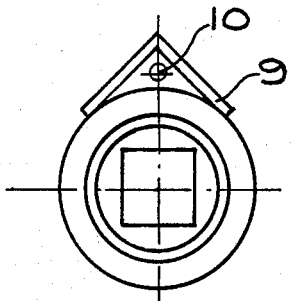
FIG. 3 is an end view taken along the lines 2—2 in FIG. 2.
Figure 4:
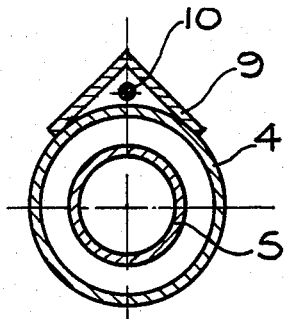
FIG. 4 is a cross section taken along the lines 3—3 in FIG. 2.
Figure 5:
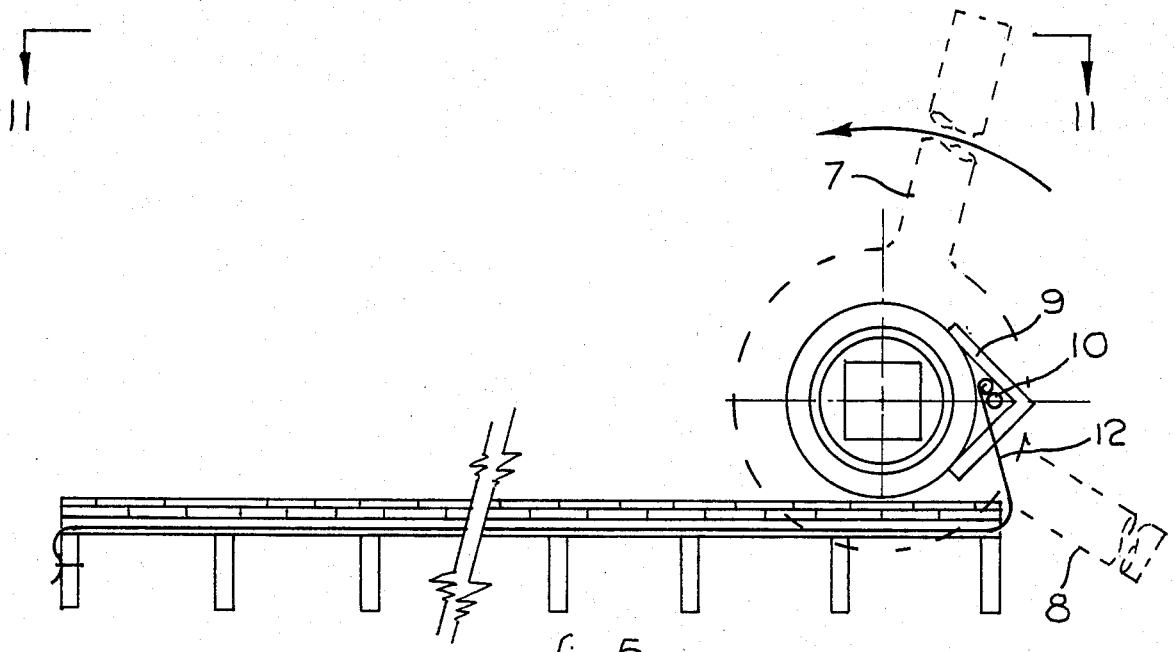
FIG. 5 is an end view showing the device set up in the start position for removing siding (in this case, the shingles of a roof).
Figure 6:
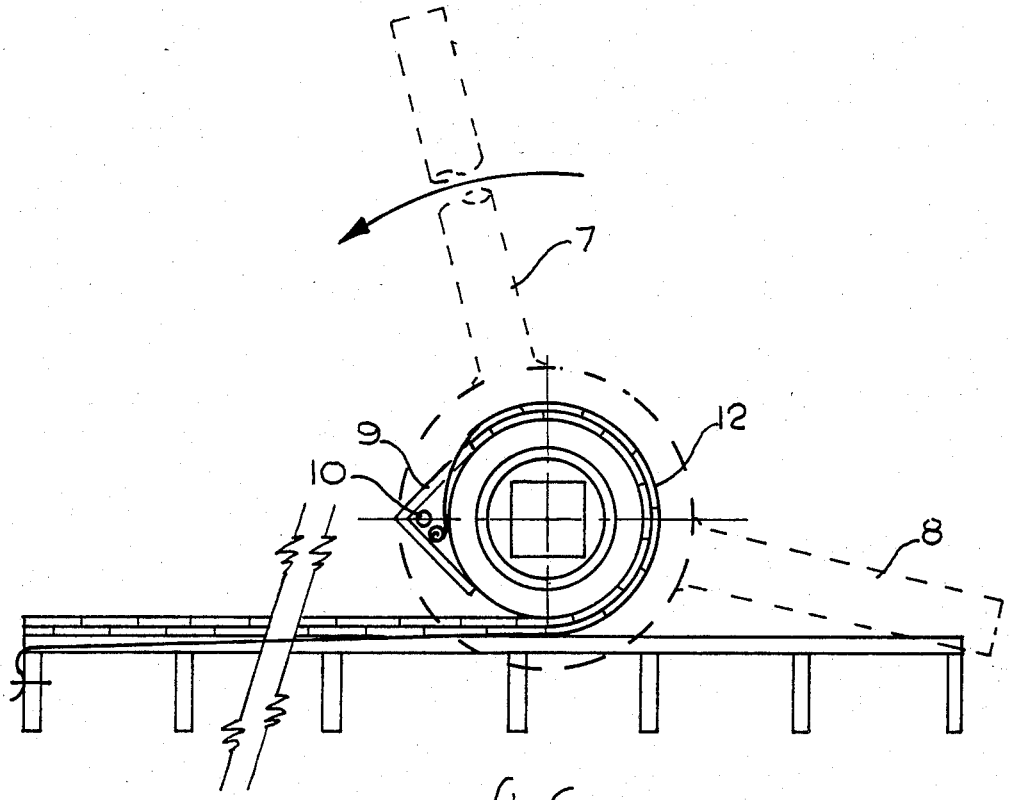
FIG. 6 is an end view showing the device half-way through the operation of removing said shingles.
Figure 7:
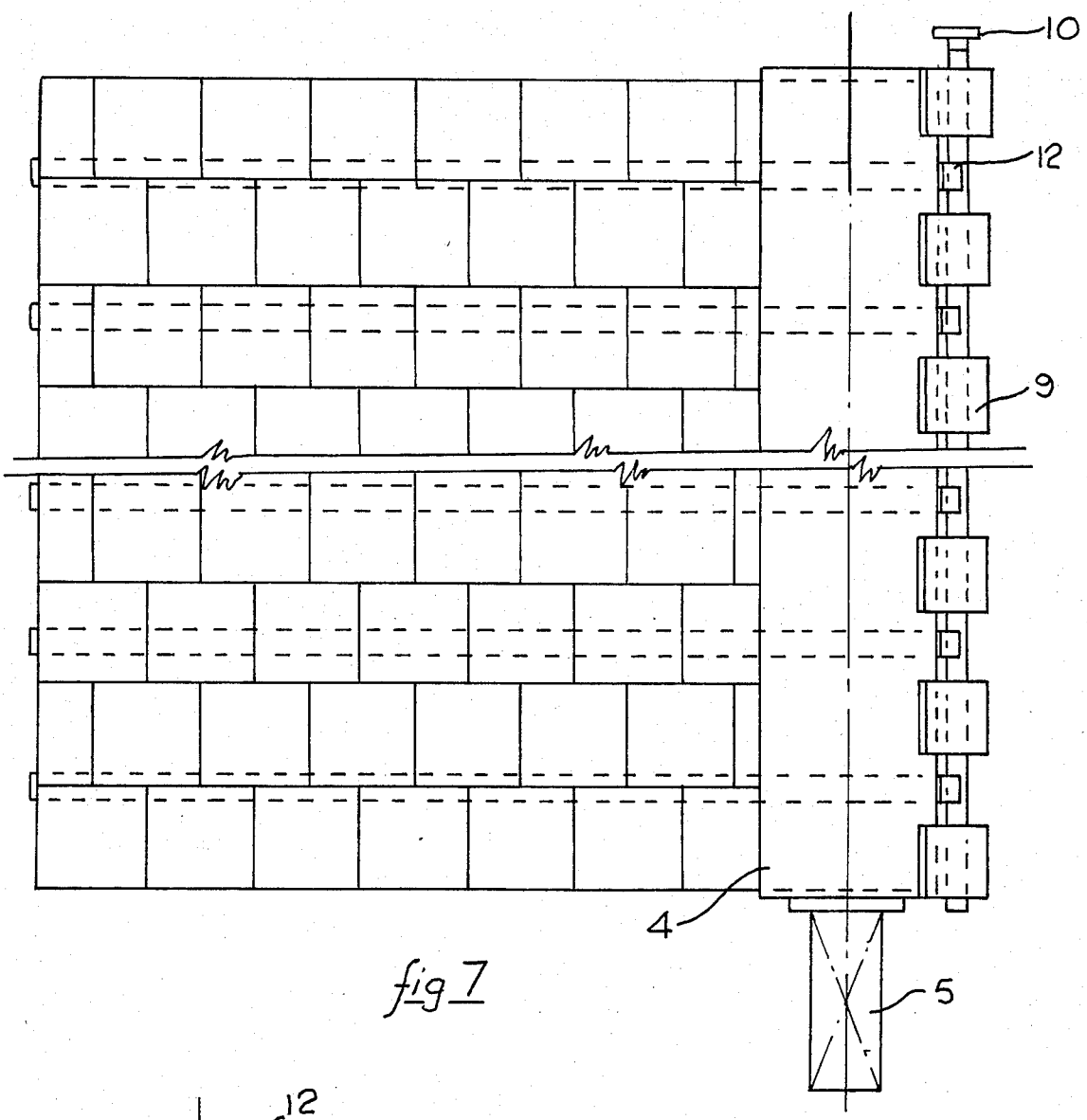
FIG. 7 is a partial plan view taken along the lines 11—11 in FIG. 5.
Figure 9:
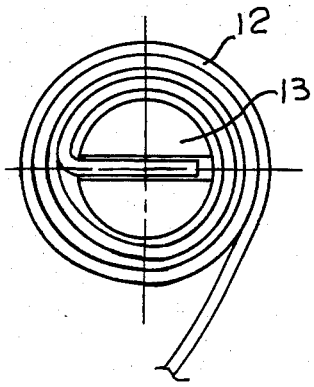
FIG. 9 is a partial end view showing the method of winding the end of the strapping.
Figure 8:
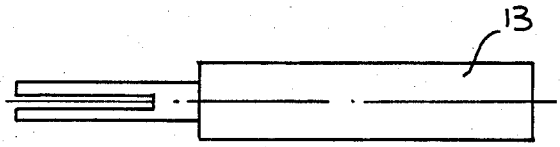
FIG. 8 is a view of the special tool for winding the strapping.

The device consists of an outer cylinder (4) and an inner cylinder (5) each of suitable material. The two cylinders are attached to each other by suitable means at one end and at the other end of the inner cylinder (5) is supported by a bearing (6) of suitable material. The purpose of the bearing (6) being to hold the two cylinders (4) & (5) concentric to each other and to accomodate wear due to any rotational movement due to flexure between the two cylinders (4) & (5).

At the free end of the inner cylinder (5) is a square section or other means of attaching a drive system. Thus, while the rotational forces are applied at one end, the drive is transferred to the other end which serves to equalize the applied forces along the length of the cylinders when in use.

Attached to the outer cylinder (4) at suitable intervals are angular sections (9). Through these angular sections (9) a rod (10) of suitable material is passed. This rod (10) provides anchorage for the strapping (12).

The siding may then be rolled into a bale, either for the entire length of the structure or for whatever length of the structure is manageable. The bale may then be secured by wrapping with strapping and clips or by tying with rope. The rod (10) may then be withdrawn and the cylinder assembly may then be removed from the bale ready for re-use. The bale of siding may then be removed from the site for disposal.

Item No. 7 indicates a ratcheting device whicy may be used for manually rotating the cylinder assembly.

Item No. 8 indicates a ratcheting device to prevent the bale of material from unwinding during the operation.

Item No. 13 indicates a special tool for coiling the end of the strapping.

We claim:

1. A covering remover comprising a cylinder assembly which includes a cylinder and a rotatable shaft within the cylinder, connected means between the shaft and the cylinder, means to axially rotate said cylinder assembly, and strapping means attached to and extending tangentially from said cylinder assembly with said strapping means providing a lifting force underneath the covering to be removed when the cylinder assembly is rotated about its axis.

2. A covering remover as in claim 1, wherein said means to axially rotate includes manual or motorized power means applied to one or both ends of said cylinder assembly.

3. A covering remover as in claim 1, wherein said strapping means is removably attached to said cylinder assembly.

4. A covering remover as in claim 3, wherein a bracket and removable rod assembly is used to attach the strapping means to said cylinder assembly.

5. A covering remover as in claim 1, wherein said means to axially rotate includes a ratcheting device to control the direction of rotation.

* * * * *